US008553902B2

(12) United States Patent
Lee

(10) Patent No.: US 8,553,902 B2
(45) Date of Patent: Oct. 8, 2013

(54) MULTI-CHANNEL BROADCASTING SYSTEM USING DIGITAL MATRIX AMPLIFIER AND METHOD OF CONTROLLING THE SAME

(75) Inventor: Sung Hee Lee, Busan (KR)

(73) Assignee: L&B Technology Co., Ltd., Busan (KR)

( * ) Notice: Subject to any disclaimer, the term of this patent is extended or adjusted under 35 U.S.C. 154(b) by 27 days.

(21) Appl. No.: 13/499,285

(22) PCT Filed: Nov. 16, 2011

(86) PCT No.: PCT/KR2011/008774

§ 371 (c)(1),
(2), (4) Date: Mar. 29, 2012

(87) PCT Pub. No.: WO2012/067436

PCT Pub. Date: May 24, 2012

(65) Prior Publication Data

US 2012/0300942 A1 Nov. 29, 2012

(30) Foreign Application Priority Data

Nov. 17, 2010 (KR) ..... 10-2010-0114252

(51) Int. Cl.
*H04R 27/00* (2006.01)

(52) U.S. Cl.
USPC ..... 381/82; 381/81; 381/85

(58) Field of Classification Search
USPC ..... 381/81, 82, 85
See application file for complete search history.

(56) References Cited

U.S. PATENT DOCUMENTS

| | | | | |
|---|---|---|---|---|
| 6,069,878 | A * | 5/2000 | Christensen | 370/263 |
| 7,571,014 | B1 * | 8/2009 | Lambourne et al. | 700/94 |
| 7,697,927 | B1 * | 4/2010 | Owens | 455/420 |
| 2007/0133824 | A1 * | 6/2007 | Hibino et al. | 381/104 |
| 2009/0313659 | A1 * | 12/2009 | Samuels | 725/78 |

FOREIGN PATENT DOCUMENTS

KR 10-2009-0001928 A * 1/2009

* cited by examiner

*Primary Examiner* — Joseph Saunders, Jr.
*Assistant Examiner* — James Mooney
(74) *Attorney, Agent, or Firm* — Rabin & Berdo, P.C.

(57) ABSTRACT

A multi-channel broadcasting system using a digital matrix amplifier performing the setting of respective equipment is provided to control the model equipment through a digital master controller. An 8-channel audio input unit 66 is electrically connected to a digital audio mixer. Sound source equipment connection terminals are electrically connected to the sound equipment. A data converter unit 46 converts each data and a contact point signal. An audio matrix IC 60 outputs an input sound source signal to an arbitrary channel. A pair of audio output terminals transmits the output signal of the audio matrix IC.

6 Claims, 8 Drawing Sheets

MULTI-CHANNEL BROADCASTING SYSTEM USING DIGITAL MATRIX AMPLIFIER AND METHOD OF CONTROLLING THE SAME

BACKGROUND OF THE INVENTION

1. Field of the Invention

The present invention relates to a multi-channel broadcasting system using a digital matrix amplifier and a method of controlling the same. More particularly, a system PC is connected to a digital master controller via a network, such that respective module equipment is controlled and the operating state is checked via the digital master controller, so that the monitoring and volume control of a plurality of broadcasting devices, which are separately provided, are carried out in one place, a predetermined volume value can be set using a one-touch button, the settings of an in-school system can be easily changed without readjusting the wiring of speakers even in the situation in which students frequently move for lessons, classrooms are frequently changed, and grades and groups are changed every semester, the operating state of respective equipment of the multi-channel broadcasting system can be checked, a specific sound source player (sound source equipment) is controlled, equipment is set, and a matrix, a speaker relay and the volume are easily controlled.

2. Description of Related Art

In a facility, which has a plurality of divided spaces, such as a school, an office building, a public office, or an apartment, a voice broadcasting system is provided in order to deliver a notification message and, in an emergency, to send an emergency alarm to people who are in respective divided spaces.

For example, in the case of a school, in-school voice broadcasting systems are separately carried out in an assembly hall, a gymnasium, an audio-visual room, a music room, and the like. In most schools, one personnel or teacher is in charge of it and manages all broadcasting equipment. In order to operate the voice broadcasting system, speakers are provided in separate spaces, such as classrooms according to grades and groups, a teachers' room, a playground, an assembly hall, and a science laboratory, and a sound source-generating unit, which supplies a suitable level of voice signal to the speakers, such as amplifier, a microphone, or an audio set, is provided in a control room.

A typical voice broadcasting system includes the sound source-generating unit, an amplifier, which amplifies and outputs a voice or audio signal output from the sound source-generating unit, and a speaker, which outputs an amplified signal output from the amplifier in the way such that it is audible to people. In addition, a speaker selection unit is provided, which electrically connect or disconnect a speaker to/from an amplifier, so that a voice or audio signal is selectively output through an intended speaker.

In this a general voice broadcasting system, there is inconvenience in that a broadcast operator must manually carry out the operation of electrically connecting every amplifier in the control room to the corresponding speaker, which is provided in an intended space in order to output voice or audio to an intended speaker.

Furthermore, broadcasting devices, such as an in-school broadcasting device, a hall-broadcasting device, an audio-visual room-broadcasting device, and a gymnasium-broadcasting device, are separately provided in the school. Therefore, there is inconvenience in that the broadcasting operator can broadcast only after entering the control room and electrically connecting the amplifier to an intended speaker in person in order to send a voice or audio signal to a speaker, which is provided in a specific zone of an assembly hall, using the hall-broadcasting device. In order to broadcast to a specific classroom using the in-school broadcasting device, the operator must enter the control room, in which the in-school broadcasting device is provided, and then electrically connect the amplifier to the speaker in the classroom in person.

In addition, in the circumstances of school classes, students frequently move for lessons, and a classroom for a specific grade and group changes every semester. In the typical voice broadcasting system, there is inconvenience in that the wiring of speakers must be readjusted whenever this situation occurs.

BRIEF SUMMARY OF THE INVENTION

Various aspects of the present invention provide a multi-channel broadcasting system using a digital matrix amplifier and a method of controlling the same, in which the monitoring and volume control of a plurality of broadcasting devices, which are separately provided, are carried out in one place, a predetermined volume value can be set using a one-touch button, the settings of an in-school system can be easily changed without readjusting the wiring of speakers even in the situation in which students frequently move for lessons, classrooms are frequently changed, and grades and groups are changed every semester, the operating state of respective equipment of the multi-channel broadcasting system can be checked, a specific sound source player (sound source equipment), a matrix, a speaker relay and the volume are easily controlled, and the setting of equipment can be adjusted.

In an aspect of the present invention, provided is a multi-channel broadcasting system that includes sound source equipment, which generates a sound source signal, and a digital audio mixer. The digital audio mixer includes a sound source input terminal having 16 channels, the sound source input terminal receiving the sound source signal from the sound source equipment, an electronic volume integrated circuit, which identifies a volume value input from the sound source input terminal, and adjusts a volume and a tone, an audio matrix integrated circuit, which outputs the sound source signal, which is transmitted from the electronic volume integrated circuit, via an arbitrary one of channel 1 to channel 8 according to a set value, and a main control integrated circuit, which controls an operation of the electronic volume integrated circuit and an operation of the audio matrix integrated circuit according to a set value, analyzes an operating state, and displays the analyzed operating state on a liquid crystal display window. The multi-channel broadcasting system also includes a digital master controller. The digital master controller includes an 8-channel audio input unit electrically connected to the digital audio mixer, a sound source equipment connection terminal, which is electrically connected to the sound source equipment to control the sound source equipment, an Ethernet connection terminal, which enables the entire system to be set and manipulated via a network, a data converter section, which converts different data and contact signals to be compliant with integrated circuit standard for equipment control, an audio matrix integrate circuit, which outputs the sound source signal via an arbitrary one of channel 1 to channel 8 according to a set value, and a pair of audio output terminals, each of which has 4 channels in order to transmit an output signal of the audio matrix integrated circuit. The multi-channel broadcasting system also includes a digital matrix amplifier. The digital matrix amplifier includes an 8-channel audio input unit, which receives the sound source signal output from the digital master controller, an audio matrix integrated circuit, which outputs the sound source signal, which is input via the audio input unit, via an arbitrary combination of channel 1 to channel 16 according to a set value, a digital amplifier section having 16 channels, the digital amplifier section amplifying the sound source signal output from the audio matrix integrated circuit, a main control integrated circuit, which controls an operation of the audio matrix integrated circuit and an operation of the digital amplifier section according to a set value, analyzes an operation state, and displaying the analyzed operation state on the liquid crystal display window, and a power amplifier, which receives the sound source signal output from the digital master controller, and amplifies power of the received sound source signal. The multi-channel broadcasting system also includes a system personal computer connected with the digital master controller via a wired/wireless network. The system personal computer monitors an operating state of the entire system including the digital audio mixer and the digital matrix amplifier, and controls the volume.

In another aspect of the present invention, provided is a method of controlling multi-channel broadcasting, in which a digital master controller controls a variety of sound source signals to be integrated and distributed through an audio mixer, to be amplified by a digital matrix amplifier, to be distributed and combined via 8×16 channels, and to be output through a speaker, which is provided in an intended space, and a window program of a system personal computer controls an entire operation of a multi-channel broadcasting system, the system personal computer being connected to the digital master controller via a wired/wireless network. The method includes the steps of: checking, at the window program, an event message, checking a TCP/IP state with the digital master controller if it is determined that there is a data change; controlling a volume by transmitting information on the data change to the digital master controller if it is determined to be connected; and storing the information on the data change in a buffer of the system personal computer if it is determined to be disconnected as a result of the checking of the TCP/IP state.

According to embodiments of the invention, the system PC is connected to the digital master controller via a network, such that respective module equipment is controlled and the operating state is checked via the digital master controller, so that the monitoring and volume control of a plurality of broadcasting devices, which are separately provided, are carried out in one place, a predetermined volume value can be set using a one-touch button.

According to embodiments of the invention, the matrix IC is applied to the full-digital type amplifier, such that the settings of the in-school system can be easily changed without readjusting the wiring of the speakers even in the situation in which students frequently move for lessons, classrooms are frequently changed, and grades and groups are changed every semester.

Furthermore, according to embodiments of the invention, the program of the system PC can be used to check the operating state of respective equipment of the multi-channel broadcasting system, which forms the multi-channel broadcasting system, to control a specific sound source player (sound source equipment), to set equipment, and to easily control the matrix, the speaker relay and the volume.

DETAILED DESCRIPTION OF THE INVENTION

Figure 1:
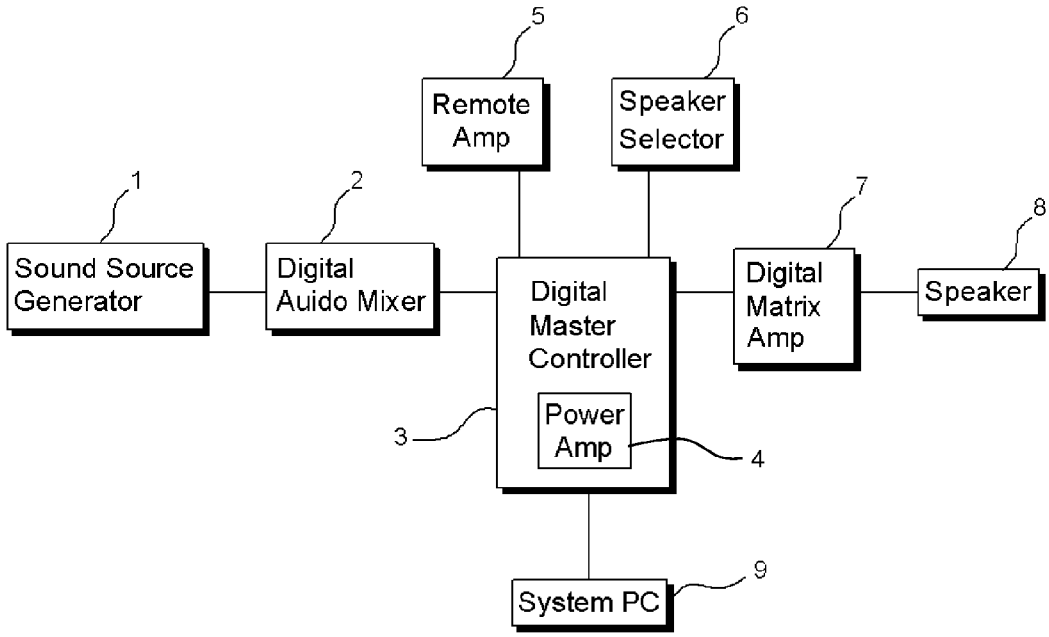
FIG. 1 is a configuration view showing a multi-channel broadcasting system using a digital matrix amplifier according to an exemplary embodiment of the invention.

The present invention will now be described more fully hereinafter with reference to the accompanying drawings, in which exemplary embodiments thereof are shown. Above all, reference should be made to the drawings, in which the same reference numerals and signs are used throughout the different drawings to designate the same or similar components. In the following description of the present invention, detailed descriptions of known functions and components incorporated herein will be omitted when it may make the subject matter of the present invention rather unclear.

Although the present invention will now be described with reference to the exemplary embodiments, it is of course to be understood that the technical scope of the invention is not restricted or limited thereto but a variety of modifications can be made and used by person having ordinary skill in the art.

FIG. 1 is a configuration view showing a multi-channel broadcasting system using a digital matrix amplifier according to an exemplary embodiment of the invention.

Referring to FIG. 1, the multi-channel broadcasting system using a digital matrix amplifier according to an exemplary embodiment of the invention includes sound source equipment 1, a digital audio mixer 2, a digital master controller 3, a digital matrix amplifier 7, and a speaker 8. In addition, the digital master controller 3 is provided therein with a power amplifier 4, and is electrically connected with a remote amplifier 5 and a speaker selector 6. Furthermore, the digital master controller 3 is connected with a system PC 9 via a wired/wireless network. When a control signal transmitted from the system PC 9 is received, the digital master controller 3 controls various module equipment, such as a digital audio mixer 2 and a digital matrix amplifier 7.

The sound source equipment 1 generates a sound source signal. Any means for generating a sound source, such as a microphone, an AF/FM radio, a cassette deck, a CD player, an alarm event-generating device, can be used without restrictions.

The digital audio mixer 2 is provided with a plurality of input channels and a plurality of output channels, and serves to output a sound source input from the sound source equipment 1 by controlling and mixing it. For example, the digital audio mixer 2 has 16×8 channels, such that the digital audio mixer 2 can receive a 16-channel sound source signal and output the sound source signal via 8 channels by controlling and mixing it.

The digital master controller 3 communicates with system PC 9, receives a control signal transmitted from a window program, which means a windowing interface of a computer system such as Microsoft Windows, or the like of the system PC 9, and controls respective module equipment using controller area network (CAN) network or the like.

The digital matrix amplifier 7 outputs input sound sources using the speaker 8 by amplifying it, and selects an input sound source and sends the selected sound source using the speaker 8, which is provided in an intended section. For example, the digital matrix amplifier 7 amplifies a sound signal input from the digital audio mixer 2, distributes and combines it according to 8×16 channels, and controls the speaker 8, which is provided in an intended space, to selectively output the sound source signal.

One or a plurality of speakers 8 is provided in each space such that it provides voice or audio to people in the space. For example, in the case of a school, speakers may be provided in classrooms, a teachers' room, a restaurant, an assembly hall, a gymnasium, an audio-visual room, and the like.

The system PC 9 is connected to the digital master controller 3 via a wired/wireless network. The system PC 9 controls respective module equipment through the digital master controller 3 and checks the operating state. For example, the system PC 9 can perform TCP/IP control over the digital master controller 3 using an operating system, such as a the window program. For separately provided broadcasting devices, for example, an in-school broadcasting device, a hall-broadcasting device, an audio-visual room-broadcasting device, and a gymnasium-broadcasting device, the system PC 9 can perform monitoring and volume control using the digital audio mixer and the digital matrix amplifier from one place, and set a predetermined volume value using a one-touch button.

Figure 2:
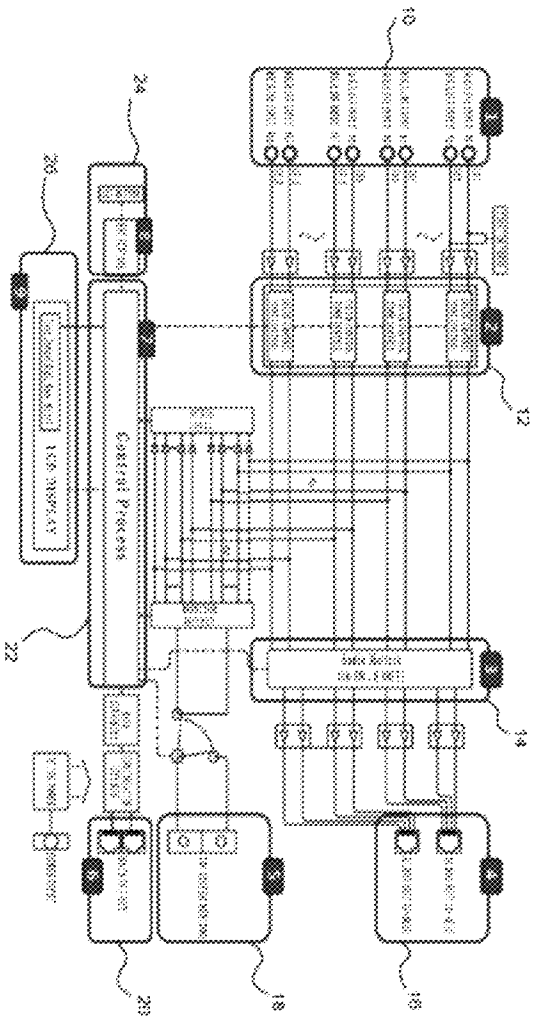
FIG. 2 is a detailed configuration view of the digital audio mixer of FIG. 1.

FIG. 2 is a detailed configuration view of the digital audio mixer of FIG. 1.

The digital audio mixer is provided with a plurality of input channels and a plurality of output channels. For example, the digital audio mixer has 16 audio input channels, such that it can be connected to 16 pieces of sound source equipment. Here, it is possible to change the output of a 16-channel input via channel 1 to channel 8 depending on the user setting. In addition, the digital audio mixer may be provided with an electronic volume device therein, such that the volume can be adjusted by manipulating a button or the window program of the system PC on an LCD display window on the front surface.

The LCD display window displays the audio level so that it can be visually identified, and supports a monitor output terminal such that the audio input/output state is audible.

Referring to FIG. 2, the digital audio mixer includes a sound source input terminal 10, an electronic volume integrated circuit (IC) 12, audio matrix IC 14, an audio output terminal 16, a monitor output terminal 18, a data input/output terminal 20, a main control IC 22, key buttons 24, and an LCD display window 26.

The sound source input terminal 10 is a section that receives a sound source signal from sound source equipment. When the sound source input terminal 10 is composed of, for example, 16 channels, channels 1 and 2 can support phantom power using microphone/line inputs.

The electronic volume IC 12 is a section that identifies the value of the volume of a sound source input from the sound source input terminal 10, and adjusts the volume and tone. For example, it can adjust the value of high, bass, and master volume.

The audio matrix IC 14 serves to output a sound signal transmitted from the electronic volume IC 12 via an arbitrary channel depending on the set value. For example, an audio matrix IC, which has 16 inputs and 8 outputs, controls the output of input audio irrespective of channels (channel 1 to channel 8) depending on the set value.

Audio output terminals 16 are RJ45 terminals, each of which has 4 channels, and are connected to audio inputs of the digital master controller. A monitor output terminal 18 is connected to the monitor of the system PC such that the audio state of the digital audio mixer is audible, so that the audio state is audible via a speaker, which is provided on the system PC monitor. Data input/output terminals 20 are RJ45 terminals, and are linked to equipment modules of the system.

The main control IC 22 serves to control all operations of the digital audio mixer, including the electronic volume IC 12 and the audio matrix IC 14, according to the set value, control the operation of the digital audio mixer according to the operation of the entire system, and analyze the operating state and display the analyzed operating state on the LCD display window 26.

The key buttons 24 are a section with which the operation setting and the state of equipment of the digital audio mixer are manipulated, and can be composed of, for example, upper, lower, left, right, ESC, and ENTER buttons.

Figure 3:
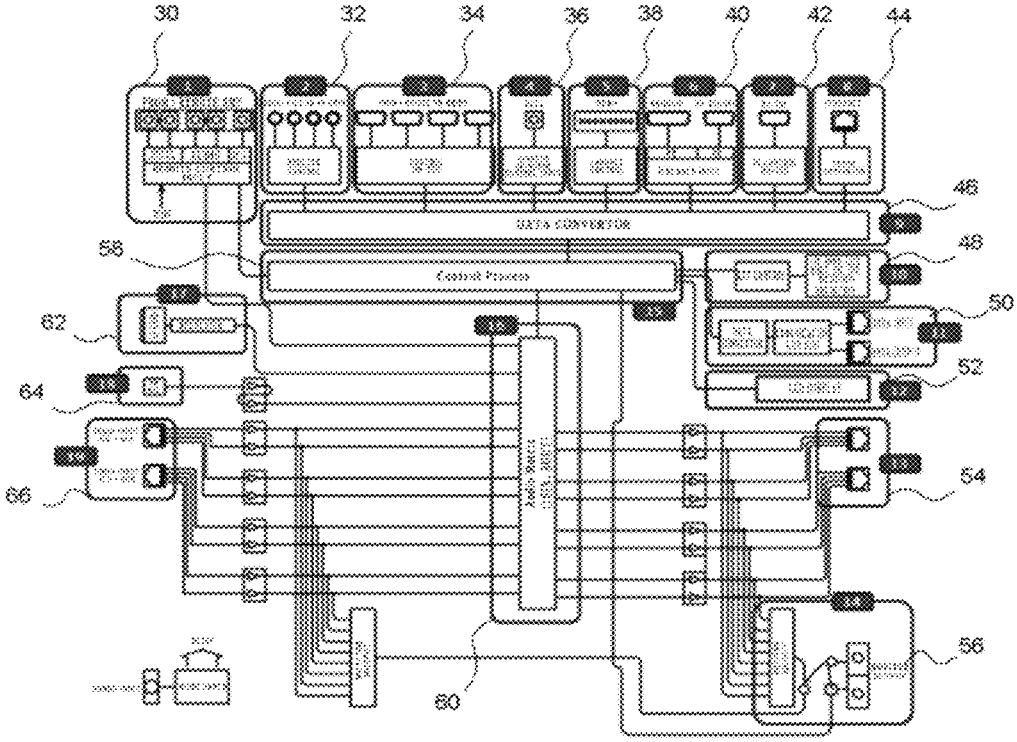
FIG. 3 is a detailed configuration view of the digital master controller of FIG. 1.

FIG. 3 is a detailed configuration view of the digital master controller of FIG. 1.

The digital master controller is main control equipment of the multi-channel broadcasting system, and cooperates with the system PC so as to act as the interface between the system PC and the system. The digital master controller enables the system to be manually and directly controlled when the system PC operates abnormally. The digital master controller has a variety of communication interface functions, such as RS-232, RS-485, DIGILINK, and CAN, such that sound source equipment, which supports DIGILINK or RS-232, (for example, a CD player, a radio set, and a cassette deck,) can be integrally controlled using the window program of the system PC.

In addition, the digital master controller includes both a P-type receiver and an R-type receiver, such that it can cooperate with a fire receiver without additional equipment. The digital master controller can send emergency automatic broadcast (e.g., MP3), which is stored in an SD cassette. The digital master controller is also provided with an emergency microphone therein, such that live broadcast can be performed when necessary. In an example, the digital master controller can output 8 audio channels, 1 MP3 player channel, 1 emergency microphone channel, and 4 remote broadcast channels, which are output from the digital audio mixer, using 8 channels according to the rank and setting of broadcast in the internal audio matrix.

A remote amplifier connection terminal 30 is connected to the remote amplifier 5, and may be composed of, for example, 6-line type 4 channels. Sound source equipment connection terminals 32 and 34 are electrically connected to sound source equipment, and control the sound source equipment. The sound source equipment connection terminals 32 and 34 include a DIGILINK connection terminal 32 and an RS-232 connection terminal 34. The DIGILINK connection terminal 32 is a terminal that is connected to sound source equipment, which supports DIGILINK, controls this sound source equipment using DIGILINK. The RS-232 connection terminal 34 is a terminal that is connected to sound source equipment, which supports RS-232, and controls this sound source equipment using RS-232. A data communication connection terminal 36 is an RJ45 terminal that is connected to the speaker selector 6. A contact point output terminal 38 is a terminal that is used when there is equipment to be controlled using a contact point. A signal input terminal 40 is a section to which a signal from a fire receiver (not shown) is input. The signal input terminal 40 is an R type (data)-receiving terminal for p-type (contact) 25 channels. The RS-232 terminal 42 is a terminal that cooperates with the system PC and cooperates with the set value of the system PC. The RJ45 terminal 44 is an Ethernet connection terminal, and enables the entire system to be set and manipulated via a network.

A data converter unit 46 is a section that converts different data and contact signals to be compliant with the IC standard for equipment control. Key buttons 48 are a section with which the operation setting and the state of equipment of the digital master controller are manipulated, and can be composed of, for example, upper, lower, left, right, ESC, ENTER, and EM MIC ON/OFF buttons. Data input/output terminals 50 are RJ45 terminals, and are linked to various equipment of this system. An LCD display window 52 displays the setting of equipment for the digital master controller or presents the state of equipment.

An audio output terminal 54 is an RJ45 terminal, and includes a pair of terminals, each of which has 4 channels in order to transmit an output signal of an audio matrix IC 60. A monitor output terminal 56 is connected to the monitor of the system PC such that the audio state of the digital master controller is audible, so that the audio state is audible through the speaker, which is provided on the system motor.

A main control IC 58 controls the set values of the operation of digital master controller equipment, and displays the state of equipment on an LCD display window 52 by analyzing it. The audio matrix IC 60 outputs a sound source signal input, which is input through an audio input unit 66, through an arbitrary one of channel 1 to channel 8 depending on the set value, and controls the output of an input sound source signal based on 16 inputs and 8 outputs, irrespective of channels (channel 1 to channel 8).

An MP3 file playing section 62 is a section that plays an MP3 file, which is recorded in an SD card. The MP3 file playing section 62 plays, for example, emergency broadcast upon receiving a fire signal. A microphone manipulating section 64 enables microphone On/OFF manipulation when announcement using a microphone is necessary, for example, in an emergency, so that live broadcast can be performed using the microphone inside the equipment.

The audio input unit 66 is an 8-channel input section, which is electrically connected to the digital audio mixer.

Figure 4:
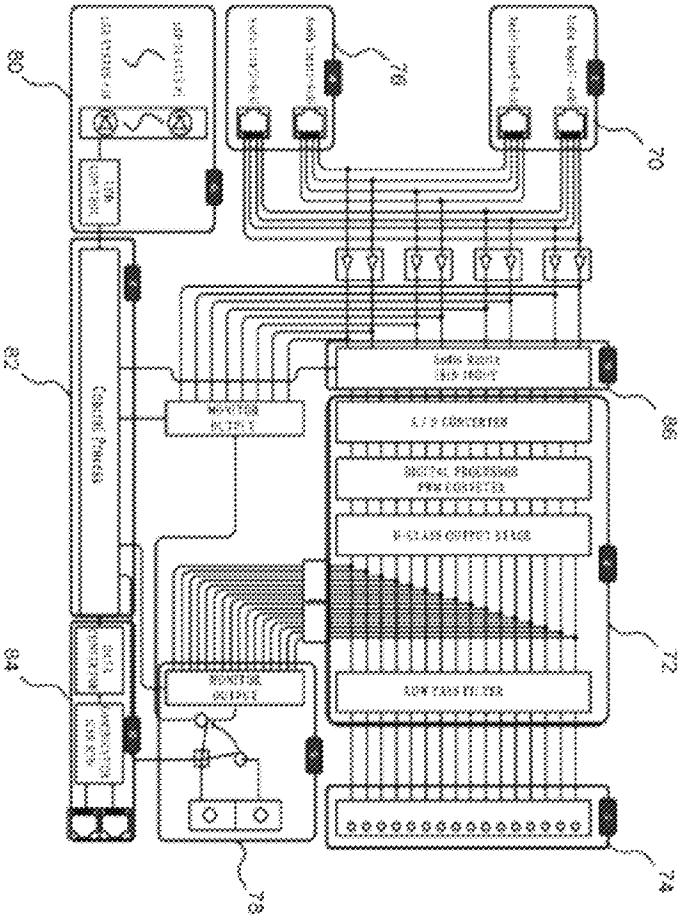
FIG. 4 is a detailed configuration view of the digital matrix amplifier of FIG. 1.
Figure 5:
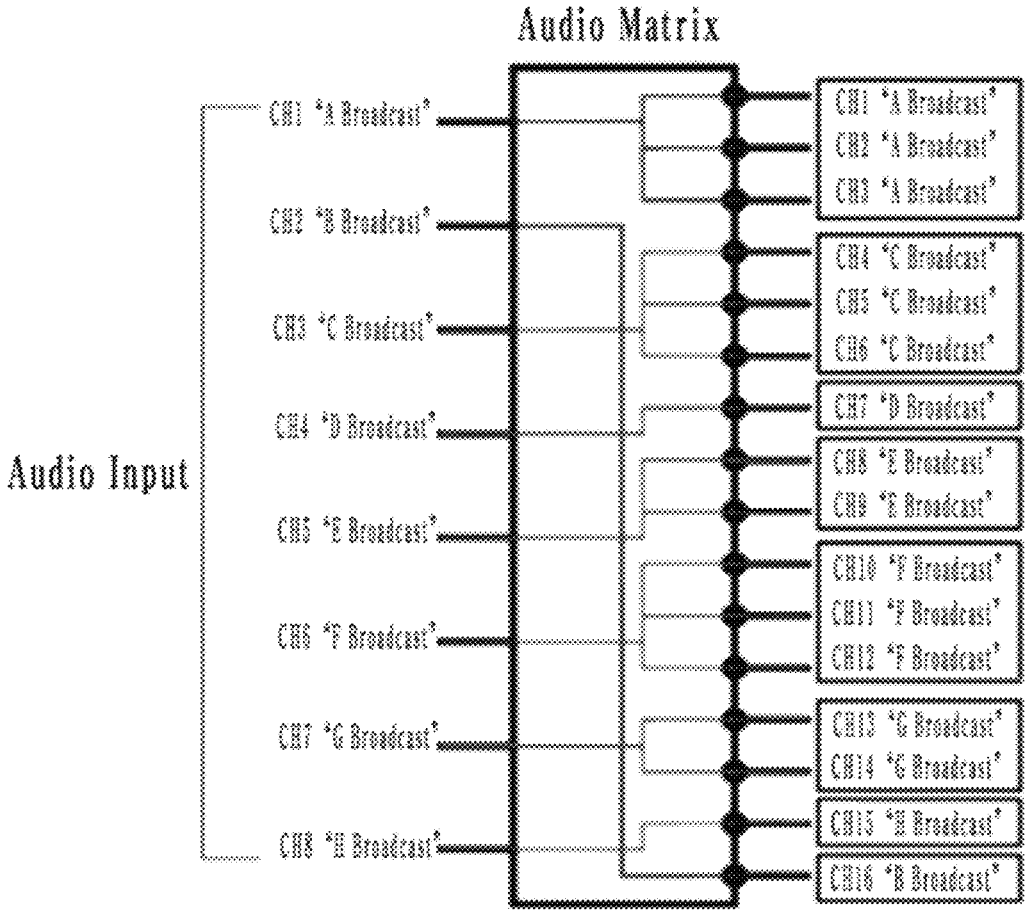
FIG. 5 is a view showing an actual application using an 8×16 channel audio matrix IC.

FIG. 4 is a detailed configuration view of the digital matrix amplifier of FIG. 1, and FIG. 5 is a view showing an actual application using an 8×16 channel audio matrix IC.

The digital matrix amplifier enables intended broadcast to be performed for respective groups according to respective channels by setting broadcast zones by a simple manipulation or using a system PC program by the application of a matrix IP to a full digital type amplifier. The digital matrix amplifier has a link output structure (confer a audio link terminal 76) such that an amplifier can be easily added, and a monitor output structure (confer a monitor output terminal 78) such that the audio state of the digital matrix amplifier is audible. It is possible to check whether or not the amplifier is abnormal via data communication between system equipment, and to control equipment from a remote place.

An audio input unit 70 is a section that receives an 8-channel sound source signal output from the digital master controller, and is an RJ45 terminal through which output audio is input depending on the set rank of broadcast.

A digital amplifier section 72 is a section that amplifies an output sound source signal using an audio matrix IC 86, has a 16-channel digital amplifier circuit, and an input of the digital amplifier section 72 is connected to an output section of the audio matrix IC 86.

A 16-channel output terminal 74 is connected to a terminal board (not shown) inside which a matching transformer is provided. The audio link terminal 76 has an RJ45 terminal inside the amplifier instead of using an existing wiring scheme, in which a line is diverged from a cable when there is a plurality of digital matrix amplifiers, or an audio distributor, such that an amplifier is easily added. The monitor output terminal 78 is connected to the monitor of the system PC, such that the audio state of the digital matrix amplifier is audible, so that the audio state is audible via the speaker on the monitor of the system PC. An LCD display window 80 enables the output state of the digital matrix amplifier equipment to be visually identified.

A main control IC 82 controls the operation of the digital matrix amplifier equipment, including the audio matrix IC 86 and the digital amplifier section 72, depending on the set values, and displays the state of equipment on the LCD display window 80 by analyzing it. A data input/output terminal 84 is an RJ45 terminal, and is linked to the equipment modules of this system.

The audio matrix IC 86 is a section that outputs a sound source signal, which is input through the audio input unit 70, via an arbitrary combination of channel 1 to channel 16 depending on the set value. The audio matrix IC that has an 8-channel input and a 16-channel output can be configured in a matrix, such that the 8-channel input can be output irrespective of the channel, as shown in FIG. 5. Referring to FIG. 5, when respective "A" to "H" broadcast audios are input to channel 1 CH1 to channel 8 CH8, the audio matrix IC combines, distributes, and allocates them, so that "A" broadcast is output via channel 1 to channel 3, "C" broadcast is output via channel 1 to channel 4 to channel 6, broadcast is output via channel 7, "E" broadcast is output via channel 8 and channel 9, "F" broadcast is output via channel 10 to channel 12, "G" broadcast is output via channel 13 and channel 14, "H" broadcast is output via channel 15, and "B" broadcast is output via channel 16.

As above, the audio matrix circuit of the digital matrix amplifier enables a specific broadcast to be easily controlled using the program of the system PC, so that it can be sent to a speaker, which is provided in a specific zone.

Figure 6:
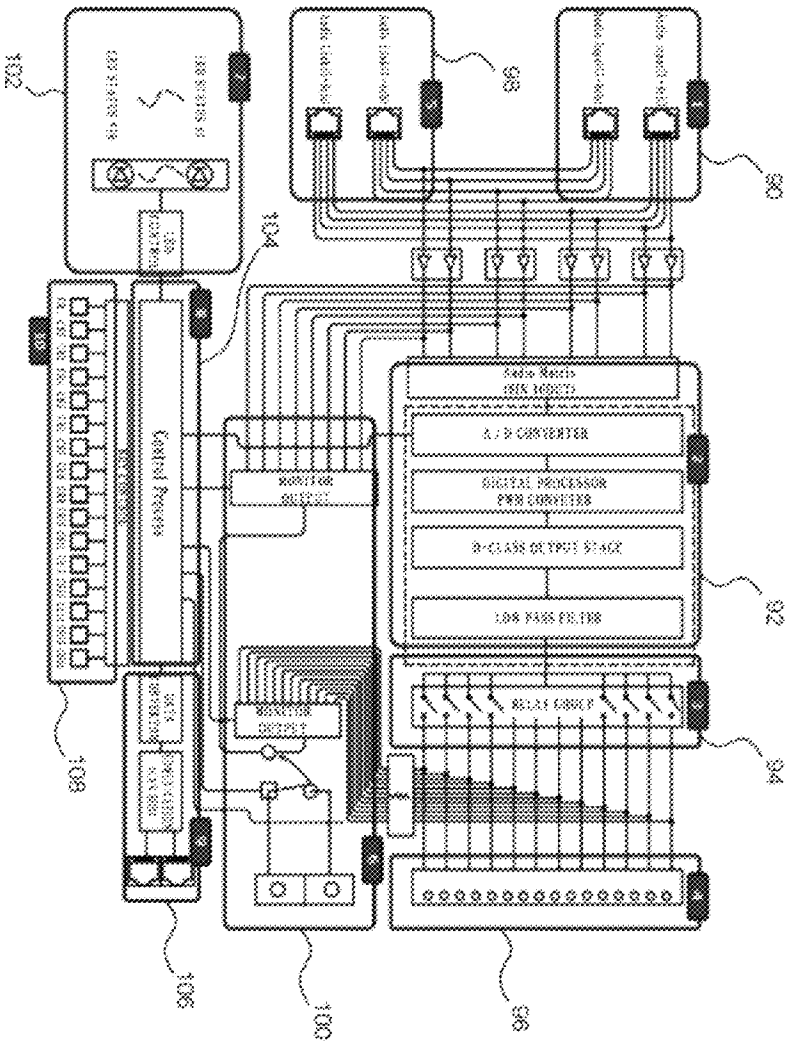
FIG. 6 is a detailed configuration view of the power amplifier, which is provided inside the digital master controller of FIG. 1.

FIG. 6 is a detailed configuration view of the power amplifier, which is provided inside the digital master controller of FIG. 1.

The power amplifier amplifies the power of a sound source signal, which is output from the digital master controller. For example, the power amplifier has an output power of 360 W, and has a speaker selection switch provided on the front surface, such that a zone to be broadcast using a speaker can be set without additional equipment.

An audio input terminal 90 is an RJ45 terminal, which inputs audio, which is output from the digital audio mixer or the digital master controller, depending on the set rank of broadcast. The digital amplifier section 92 has a 360 W digital amplifier circuit to efficiently amplify audio, which is input from the matrix power amplifier. An input of the digital amplifier section 92 is connected to the output section of the audio matrix amplifier.

A relay group 94 enables a relay to be driven in response to the manipulation of a switch on the front of the power amplifier or the manipulation of a selection switch of the system PC or the speaker, so that a broadcast can be carried out in an intended zone. An output terminal 96 is connected to a terminal board, inside which a matching transformer is provided.

An audio link terminal 98 is a terminal for the addition of an amplifier when a plurality of digital matrix amplifiers is used. A monitor output terminal 100 is connected to the monitor of the system PC, such that the audio state of the power amplifier equipment is audible. The LCD display window 102 enables the output state of the power amplifier equipment to be visible.

The main control IC 104 controls the set values of the operation of the power amplifier equipment, analyzes the state of equipment, and displays it on the LCD display window 102. A data input/output terminal 106 is linked with the system equipment of the invention, and a broadcast area selection switch 108 is a switch, with which a broadcast zone is selected by manipulating the relay group inside the power amplifier.

Figure 7:
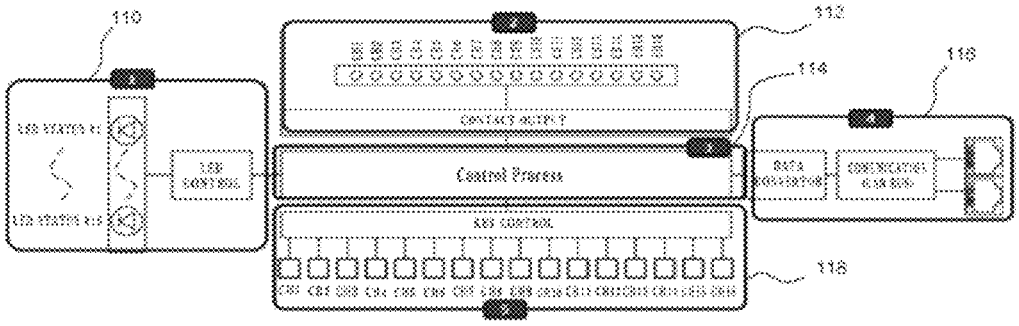
FIG. 7 is a detailed configuration view of the speaker selector of FIG. 1.

FIG. 7 is a detailed configuration view of the speaker selector of FIG. 1.

The speaker selector is disposed on front of the equipment. With the speaker selector, 16-channel speakers can be selected. An indicator lamp is used for each switch, such that a selected channel can be easily identified. In the speaker lines, 8 speaker lines are simultaneously operated each time using a group 1 switch (channel 1 to channel 8) or a group 2 switch (channel 9 to channel 16). It is also possible to control the whole lines at the same time using an all-select switch.

An LCD state indicator 110 allows the output state of the speaker selector to be visually identified, and a contact output section 112 outputs a contact point in response to the operation of a switch on the front thereof, thereby enabling contact point control. A data input/output terminal 114 is linked to the system equipment of the invention, and the main control IC 116 controls the operation of the speaker selector equipment according to the set value, analyzes the state of the equipment, and displays on the LCD state indicator 110.

A speaker channel selection switch 118 is a switch that is used for selecting the channel of a speaker, and includes switches for respective channels that include channel 1 to channel 16, a group 1 channel switch (1CH to 8CH), a group 2 channel switch (9CH to 16CH), and an all-select switch.

The present invention has the following features.

In a facility, for example, a school, which has a plurality of divided spaces, the operation of broadcasting devices, which are separately constructed for a broadcasting studio, an assembly hall, an audio-visual room, and the like, is integrated using an in-school network. The state of operating the entire in-school broadcasting system is checked and managed on the window program in the broadcasting studio. This system can be realized by adding the digital audio mixer and the digital matrix amplifier to the existing equipment, and be managed at a low cost.

In a power amplifier PA broadcast monitor system, which is currently used, an input monitor and an output monitor are separately provided for use. The system monitor of the system PC according to an embodiment of the invention can support both input monitoring and output monitoring. An output monitor is provided with the function of checking a speaker circuit, such that it can detect whether or not the speaker circuit has a short circuit or normally operates, so that the result can be identified using the PC program.

Since the matrix IC is applied to the full digital type amplifier, a simple change can be made using the PC program when the grade or class is changed at every semester. In addition, power line data communication, which is not used in the traditional broadcasting system, can be applied to the system, so that the time for installing the system is reduced, the wiring for the system is simplified, the firmness of the system is maximized, and quick maintenance is possible after the installation of the system is completed. When only the system is powered on, the state of the equipment can be identified and a suitable action may be made from the system equipment or via the Ethernet from a remote place.

Furthermore, the degree of noise in a classroom can be checked using an existing classroom speaker and an existing speaker cable without additional construction. When the level of noise is equal to or higher than a reference level which is set in the program, an event can be generated using a display or a signal sound in order to notify a teacher who is in charge of it.

Next, a description will be given of a method of controlling multi-channel broadcast according to an exemplary embodiment of the invention.

In the method of controlling multi-channel broadcast according to an exemplary embodiment of the invention, the digital master controller controls the process of integrating and distributing a variety of sound source signals using the audio mixer, amplifying the sound source signals using the digital matrix amplifier, distributing and combining the sound source signals via 8×16 channels, and then selectively outputting the sound source signals via a speaker, which is provided in an intended space. In addition, the entire multi-channel broadcasting system is controlled using the window program of the system PC, which is connected to the digital master controller via a wired/wireless network.

The window program of the system PC checks for the operating state of respective equipment, which constitutes the multi-channel broadcasting system, controls specific sound source players (sound source equipment), sets up the equipment, and controls the matrix, the speaker relay, and the volume.

Figure 8:
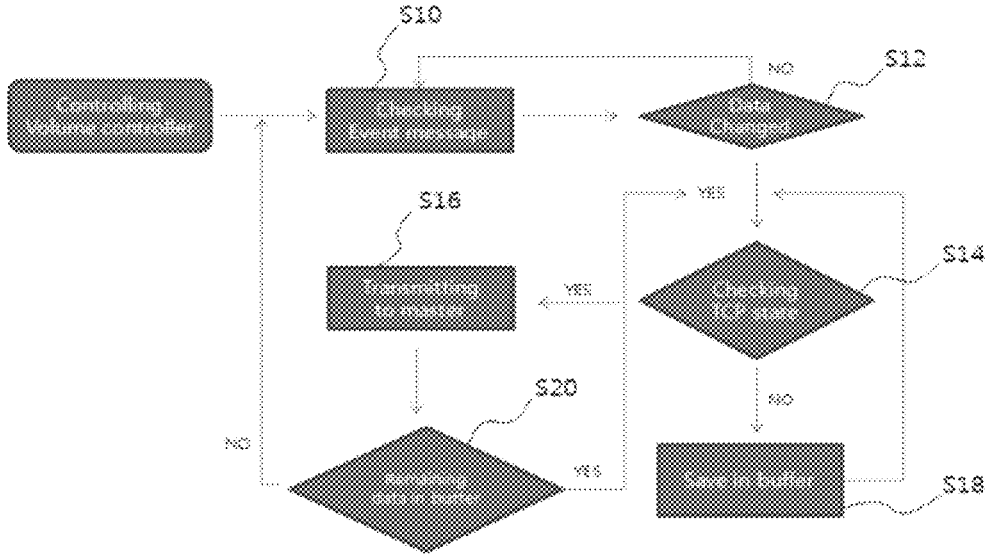
FIG. 8 is a flowchart showing the process of volume control in a method of controlling multi-channel broadcast according to an exemplary embodiment of the invention.

FIG. 8 is a flowchart showing the process of volume control in a method of controlling multi-channel broadcast according to an exemplary embodiment of the invention.

The window program of the system PC controls the volume of the system. Step S10 is the step of checking, by the window program, whether or not there is an event message. The event message is generated as a form of data, which has a display signal, a sound signal, or a specific message. When the level of noise in a space, in which a respective speaker is provided, is checked, if the level of noise is equal to or greater than a predetermined level, the event message is generated. In an example, when the level of noise in a specific classroom (e.g. a classroom for group 2 students in a third grade) is excessive, an event message may not be properly delivered to the students or a teacher in the classroom if the event message is in the normal volume level. Therefore, a noise detection sensor or the like is mounted on the speaker, which is provided inside the classroom, in order to check the level of noise in the classroom in real time. When the level of noise equal to or greater than a specific reference level is detected, the control processing must be performed in order to increase the volume of broadcast.

Step S12 is the step of determining whether or not there is a data change from the previous state, as the result of checking the event message.

Step S14 is the step of checking the TCP/IP connection state (communication state) between the system PC and the digital master controller when it is determined that there is a data change as the result of the step S12. When the connection is detected as the result of this step, information on a data change is transmitted to the digital master controller in the step S16. In contrast, when it is determined that the communication state is disconnected, information on a data change is stored in the buffer of the system PC for the moment in step S18, and the communication connection state checked again.

When the information on a data change is received, the digital master controller controls the volume of the system using the information on a data change. In addition, the window program checks whether or not there is data left in the buffer of the system PC in step S20. If there is data left, the communication connection state with the digital master controller is checked. If there is no data left, the step of checking the event message is repeated.

Based on this process, the system PC checks the level of noise in a specific classroom. If the level of noise is equal to or greater than the reference level, an event generation command is transmitted to the digital master controller. The system PC checks the event message, and if it is determined there is a data change, transmits information on the data change to the digital master controller after checking the communication state. In this way, the volume can be further increased. Here, the digital master controller can, of course, check the level of noise, detect the generation of noise, and generate an event, so that the window program of the system PC can check the event, which is generated in this way.

Figure 9:
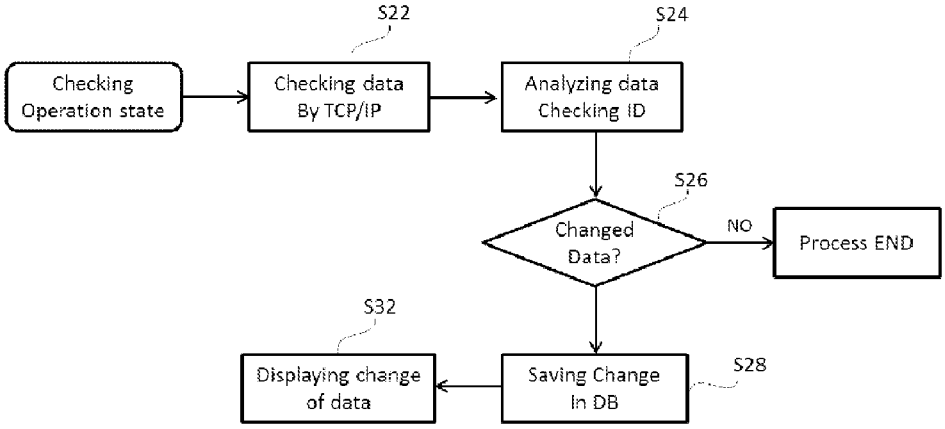
FIG. 9 is a flowchart showing the process of checking the operating state of an equipment module in the method of controlling multi-channel broadcast according to an exemplary embodiment of the invention.

FIG. 9 is a flowchart showing the process of checking the operating state of an equipment module in the method of controlling multi-channel broadcast according to an exemplary embodiment of the invention.

The window program of the system PC checks whether or not there is data transmitted through the TCP/IP in step S22, and if there is data, identifies the ID of equipment, which transmitted the data, by analyzing the data in step S24. Afterwards, the window program determines whether or not there is a data change from before the analysis of data in S26. If there is a data change from the existing data as the result of determination, the window program stores the change in the database of the system PC in step S28, and displays the amount of the data change on a monitor or the like in step S32. In this way, the operating state of the corresponding equipment can be checked. Since a change from the existing data is stored in the database of the system PC, the present data is compared with the previous data, which is stored in the database, when determining whether or there is a data change.

The present invention has been described in an illustrative manner.

The foregoing description is merely an example that illustrates the technical principle of the invention, but a variety of modifications, changes and substitutions without departing from the essentials of the invention will be possible to a person having ordinary skill in the art. Accordingly, the foregoing embodiments disclosed herein and the accompanying drawings should be regarded as illustrative rather than limiting the technical principle of the invention. The scope of the invention is not defined by the embodiments and the accompanying drawings. It should be understood that the scope of protection of the invention shall be defined by the appended claims and all equivalent technical principles thereof, which are construed to fall within the scope of the invention.

INDUSTRIAL APPLICABILITY

The present invention is widely applicable to the fields of designing of a broadcast system, which sends a specific sound source to respective speakers provided in a space that is divided into a plurality of zones, and particularly, a school broadcast system, and to the fields of manufacturing of the equipment of the same system.

What is claimed is:

1. A multi-channel broadcasting system, comprising:

sound source equipment, which generates a sound source signal;

a digital audio mixer, wherein the digital audio mixer comprises:

a sound source input terminal having 16 channels, the sound source input terminal receiving the sound source signal from the sound source equipment, an electronic volume integrated circuit, which identifies a volume value input from the sound source input terminal, and adjusts a volume and a tone, an audio matrix integrated circuit, which outputs the sound source signal, which is transmitted from the electronic volume integrated circuit, via an arbitrary one of channel 1 to channel 8 according to a set value, and a main control integrated circuit, which controls an operation of the electronic volume integrated circuit and an operation of the audio matrix integrated circuit according to a set value, analyzes an operating state, and displays the analyzed operating state on a liquid crystal display window;

a digital master controller, wherein the digital master controller comprises:

an 8-channel audio input unit electrically connected to the digital audio mixer, a sound source equipment connection terminal, which is electrically connected to the sound source equipment to control the sound source equipment, an Ethernet connection terminal, which enables the entire system to be set and manipulated via a network, a data converter section, which converts different data and contact signals to be compliant with integrated circuit standard for equipment control, an audio matrix integrate circuit, which outputs the sound source signal via an arbitrary one of channel 1 to channel 8 according to a set value, a pair of audio output terminals, each of which has 4 channels in order to transmit an output signal of the audio matrix integrated circuit, and a power amplifier, which receives the sound source signal output from the digital master controller, and amplifies power of the received sound source signal;

a digital matrix amplifier, wherein the digital matrix amplifier comprises:

an 8-channel audio input unit, which receives the sound source signal output from the digital master controller, an audio matrix integrated circuit, which outputs the sound source signal, which is input via the audio input unit, via an arbitrary combination of channel 1 to channel 16 according to a set value, a digital amplifier section having 16 channels, the digital amplifier section amplifying the sound source signal output from the audio matrix integrated circuit, and a main control integrated circuit, which controls an operation of the audio matrix integrated circuit and an operation of the digital amplifier section according to a set value, analyzes an operation state, and displaying the analyzed operation state on the liquid crystal display window;

and a system personal computer connected with the digital master controller via a wired/wireless network, wherein the system personal computer monitors an operating state of the entire system including the digital audio mixer and the digital matrix amplifier, and controls the volume.

2. The multi-channel broadcasting system of claim 1, wherein the system personal computer checks a level of noise in a space in which a respective speaker is provided, and if noise exceeding a predetermined reference level occurs, transmits a command to the digital master controller, instructing to generate an event message using a display or a signal sound.

3. The multi-channel broadcasting system of claim 2, wherein the system personal computer controls the volume by checking the event message, checking a TCP state if it is determined that there is a data change, and then transmitting information on the data change to the digital master controller.

4. A method of controlling multi-channel broadcasting, in which a digital master controller controls a variety of sound source signals to be integrated and distributed through an audio mixer, to be amplified by a digital matrix amplifier, to be distributed and combined via 8×16 channels, and to be output through a speaker, which is provided in an intended space, and a window program of a system personal computer controls an entire operation of a multi-channel broadcasting system, the system personal computer being connected to the digital master controller via a wired/wireless network, the method comprising:

checking, at the window program, an event message, and checking a TCP/IP state with the digital master controller if it is determined that there is a data change;

controlling a volume by transmitting information on the data change to the digital master controller if it is determined to be connected; and storing the information on the data change in a buffer of the system personal computer if it is determined to be disconnected as a result of the checking of the TCP/IP state.

5. The method of claim 4, wherein the window program checks whether or not there is data left in the buffer of the system personal computer, checks the TCP/IP state with the digital master controller if there is the data left, and checks the event message again if the buffer is vacant.

6. The method of claim 5, wherein the window program checks an identification of corresponding equipment by analyzing data if the data is transmitted via TCP/IP, and if there is a change to the data from existing data, checks an operating state of the equipment by storing the change in a database and then visually displaying an amount of the change in the data.

* * * * *